US005418433A

United States Patent [19]

Nilssen

[11] Patent Number: 5,418,433

[45] Date of Patent: May 23, 1995

[54] FLASHLIGHT WITH HYBRID BATTERY AND ELECTRONIC CONTROL CIRCUIT

[76] Inventor: Ole K. Nilssen, Caesar Dr., Barrington, Ill. 60010

[21] Appl. No.: 442,914

[22] Filed: Nov. 28, 1989

Related U.S. Application Data

[63] Continuation-in-part of Ser. No. 410,745, Sep. 9, 1989, abandoned.

[51] Int. Cl.[6] ..... H05B 37/02

[52] U.S. Cl. ..... 315/175; 315/176; 315/291; 315/307; 362/157

[58] Field of Search ..... 200/60; 362/157, 205; 315/170, 171, 175, 172, 209 R, 176, 291, 307; 320/3, 4; 323/222

[56] References Cited

U.S. PATENT DOCUMENTS

| | | | |
|---|---|---|---|
| 3,885,148 | 5/1975 | Di Benedetto | 362/205 |
| 4,023,067 | 5/1977 | Zelina et al. | 315/209 R |
| 4,234,822 | 11/1980 | Garrison et al. | 315/209 R |
| 4,257,088 | 3/1981 | Nilssen | 315/243 X |
| 4,499,525 | 2/1985 | Mallory | 362/157 |
| 4,651,061 | 3/1987 | Spissinger | 315/171 |
| 4,667,142 | 5/1987 | Butler | 320/16 |
| 4,777,427 | 10/1988 | Kiyohara | 323/222 |
| 4,920,302 | 4/1990 | Konopka | 315/307 |

*Primary Examiner*—Joseph A. Popek
*Assistant Examiner*—Son Dinh

[57] ABSTRACT

A flashlight has a hybrid battery pack consisting of a primary-cell battery (ex: an Alkaline battery) and an auxiliary rechargeable battery of low internal resistance (ex: a Ni—Cad battery). Connected in circuit between the batteries and the flashlight's light bulb is a slide switch and an electronic control circuit. The slide switch has an OFF-position, an ON-position, and a spring-loaded variable BOOST-position. In full BOOST, the electronic control circuit operates such as to apply a voltage of about 1.5 times normal magnitude to the light bulb; thereby increasing the flashlight's light output by a factor of about 4.0 above normal. However, at that degree of BOOST, if indeed maintained on a continuous basis, the life of the light bulb will be shortened to about 15 minutes versus about 50 hours when used in the normal ON-position. The function of the auxiliary battery, which is controllably charged by the primary-cell battery, is that of permitting the size of the primary-cell battery to be much smaller than otherwise would be required to provide the increased power associated with the BOOST-position.

6 Claims, 3 Drawing Sheets

FLASHLIGHT WITH HYBRID BATTERY AND ELECTRONIC CONTROL CIRCUIT

RELATED APPLICATION

This application is a Continuation-in-Part of application Ser. No. 07/410,745 filed Sep. 9, 1989, now abandoned.

BACKGROUND OF THE INVENTION

1. Field of the Invention

The present invention relates to flashlights and similar battery-powered light sources.

2. Background of the Invention

Flashlights are well known products; which, in many situations provide much less light than might be wanted.

SUMMARY OF THE INVENTION

Objects of the Invention

An object of the present invention is the provision of cost-effective means whereby the light output from a battery-powered light source, such as a flashlight, might be boosted beyond what normally would be obtained.

Another object is that of providing for a special battery pack comprising a combination of a more-or-less ordinary primary-cell battery with a rechargeable battery having low internal resistance.

These as well as other objects, features and advantages of the present invention will become apparent from the following description and claims.

Brief Description

A flashlight has a hybrid battery pack consisting of a primary-cell battery (such as an ordinary Alkaline battery) and an auxiliary rechargeable battery of low internal resistance (such as a collection of ordinary Ni—Cad cells). Connected in circuit with the batteries and the flashlight's light bulb is a slide switch and an electronic control circuit. The slide switch has an OFF-position, an ON- position, and a spring-loaded variable BOOST-position. In full BOOST, the electronic control circuit operates such as to apply a voltage of about 1.5 times normal magnitude to the light bulb; thereby increasing the flashlight's light output by a factor of about 4.0 above normal. However, at that degree of BOOST, if indeed maintained on a continuous basis, the life of the light bulb will be shortened to about 15 minutes versus about 50 hours when used in the normal ON-position.

The function of the auxiliary battery, which is controllably charged on command from the primary-cell battery, is that of permitting the size of the primary-cell battery to be much smaller than otherwise would have been required to provide the increased power associated with the BOOST-position.

DESCRIPTION OF THE PREFERRED EMBODIMENT

Details of Construction

Figure 1:
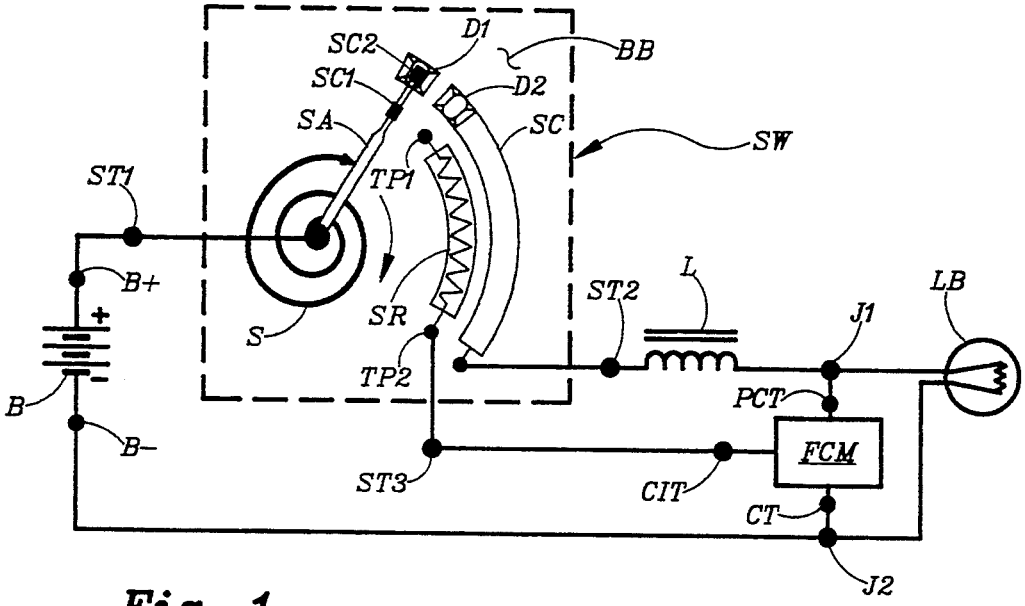
FIG. 1 schematically illustrates the invention in its basic embodiment.

FIG. 1 schematically illustrates a basic embodiment of the invention in the form of an electrical circuit diagram.

In FIG. 1, a battery B has a B+ terminal and a B− terminal. The B+ terminal is connected with a switch terminal ST1 of a slide switch SW; which switch terminal, in turn, is connected with a slideable arm SA of slide switch SW. Slideable arm SA is connected with a spring S, and has first and second slide contactors SC1 and SC2, as well as a slide conductor SC and a slide resistor SR. Slide conductor SC and slide resistor SR are both mounted on a back board BB; in which back board there is a first detent D1. Slide conductor SC, in which there is a second detent D2, is connected with a switch terminal ST2. Slide resistor SR has a first terminal point TP1 and a second terminal point TP2; which second terminal point is connected with a switch terminal ST3.

An energy-storing inductor L is connected between switch terminal ST2 and a first junction J1; and a light bulb LB is connected between first junction J1 and a second junction J2.

A forward converter means FCM has: (i) a common terminal CT, which is connected with second junction J2; (ii) a power control terminal PCT, which is connected with first junction J1; and (iii) a control input terminal CIT, which is connected with switch terminal ST3.

Figure 2:
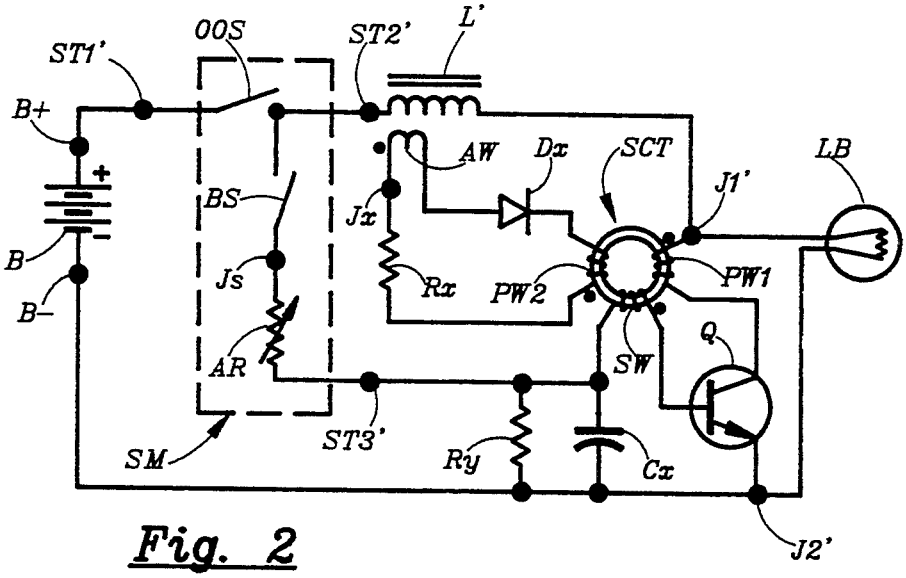
FIG. 2 diagrammatically illustrates a forward converter of a type suitable for use in the basic embodiment.

FIG. 2 diagrammatically illustrates a forward converter of a type suitable for use in the basic embodiment of FIG. 1.

In FIG. 2, battery B and battery terminals B+ and B− are equivalent to the corresponding elements of FIG. 1. However, slide switch SW of FIG. 1 has been replaced with a switch means SM; which has a first switch terminal ST1′, a second switch terminal ST2′, and a third switch terminal ST3′. Within switch means SM is: (i) an ON-OFF switch OOS connected between switch terminals ST1′ and ST2′; (ii) a BOOST switch BS connected between switch terminal ST2′ and a junction Js; and (iii) an adjustable resistor AR connected between junction Js and switch terminal ST3′.

An energy-storing inductor L′, corresponding to energy-storing inductor L of FIG. 1, is connected between switch terminal ST2′ and a first junction J1′; which energy-storing inductor has an auxiliary winding AW, whose terminals are connected between the anode of diode Dx and a junction Jx.

A transistor Q is connected with its emitter to a second junction J2′, and—by way of a first primary winding PW1 of a saturable current transformer SCT—is connected with its collecter to junction J1′. The base of transistor Q is connected with switch terminal ST3′ by way of secondary winding SW of saturable current transformer SCT.

A resistor Rx is connected with the cathode of diode Dx by way of a second primary winding PW2 of saturable current transformer SCT. Another resistor Ry and a capacitor Cx are both connected between switch terminal ST3' and junction J2'.

Light bulb LB is connected between junctions J1' and J2'.

Figure 3:
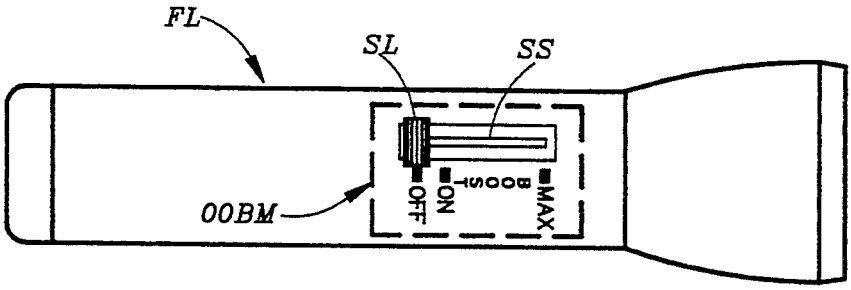
FIG. 3 illustrates a flashlight made in accordance with the invention.

FIG. 3 illustrates a flashlight FL made in accordance with the invention.

In FIG. 3, an ON/OFF/BOOST control means OOBM—which corresponds to slide switch SW of FIG. 1—has a slide lever SL slideably movable in a slide slot SS between markings OFF, ON, BOOST and MAX.

Figure 5:
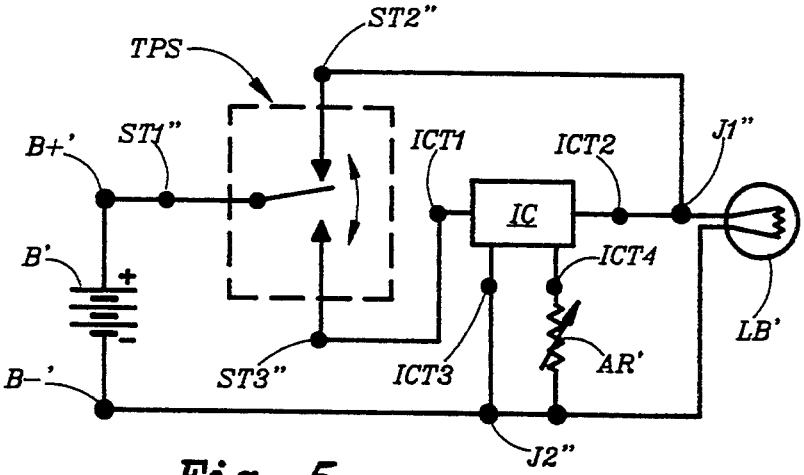
FIG. 5 schematically illustrates an alternative basic embodiment of the invention.

FIG. 5 schematically illustrates an alternative embodiment of the invention. In FIG. 5, a battery B' has B+' and B−' terminals. A three-position switch TPS has: (i) a first switch terminal ST1", Which is connected with the B+ terminal; (ii) a second switch terminal ST2", which is connected with a first junction J1"; and (iii) a third switch terminal ST3", which is connected with a first IC terminal ICT1 of an integrated circuit IC.

A second IC terminal ICT2 is connected with first junction J1". A third IC terminal ICT3 is connected with a second junction J2"; which is also connected with the B−' terminal. A fourth IC terminal ICT4 is connected with second junction J2" by way of an adjustable resistor AR'. A light bulb LB' is connected between junctions J1" and J2".

Figure 7:
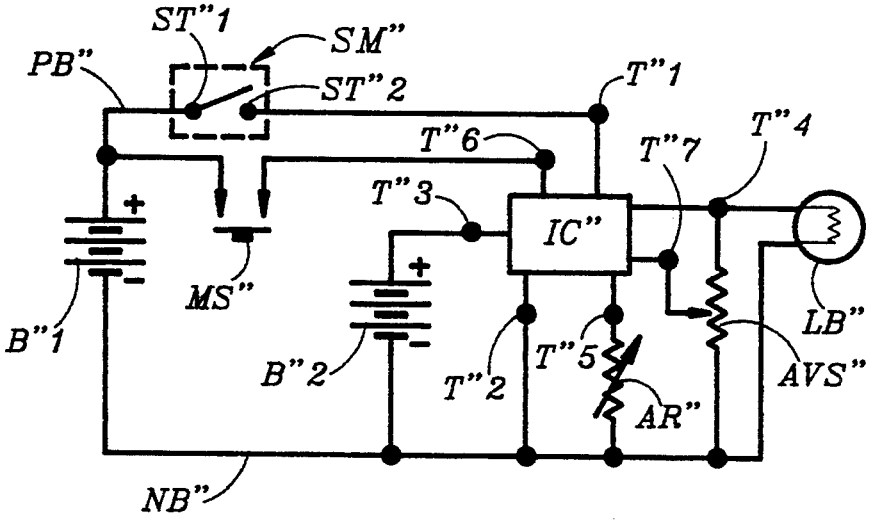
FIG. 7 schematically illustrates the invention in its basic preferred embodiment.

FIG. 7 illustrates the preferred embodiment of the invention in the form of a schematic electric circuit diagram.

In FIG. 7, a first battery B"1 is connected with its negative terminal to a negative bus NB" and with its positive terminal to a positive bus PB".

Positive bus PB" is connected with a first switch terminal ST"1 of a switch means SM". A second switch terminal ST"2 of switch means SM" is connected with a first terminal T"1 of an integrated circuit IC". A second terminal T"2 of integrated circuit IC" is connected with negative bus NB".

A second battery B"2 is connected with its positive terminal to a third IC terminal T"3 of integrated circuit IC". A light bulb LB" is connected with its two terminals between negative bus NB" and a fourth terminal T"4 of integrated circuit IC".

An adjustable resistor AR" is connected between negative bus NB" and a fifth terminal T"5 of integrated circuit IC".

A momentary switch MS" is connected between positive bus PB" and a sixth terminal T"6 of integrated circuit IC".

An adjustable voltage sensor AVS" is connected between negative bus NB", terminal T"4 and a seventh terminal T"7 of integrated circuit IC".

Explanation of Waveforms

Figure 4:
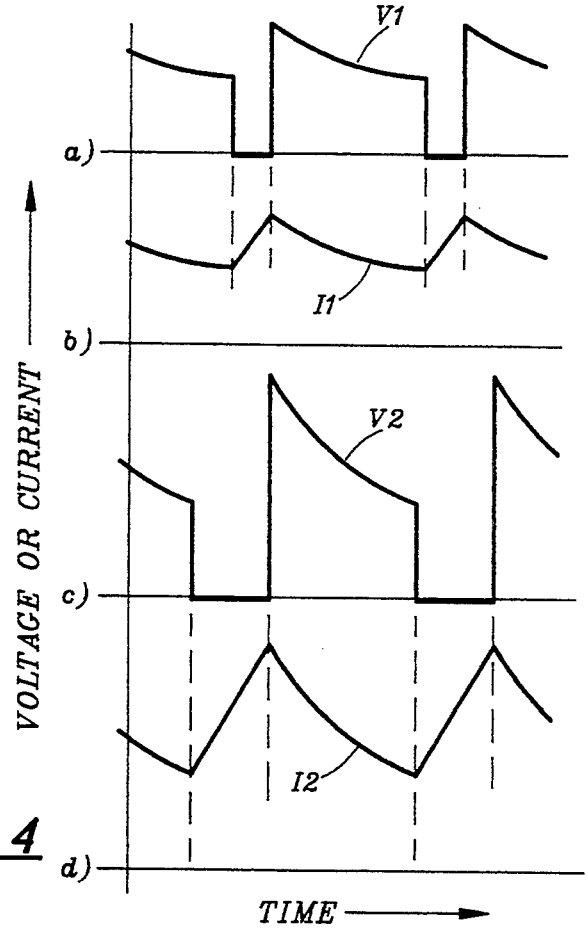
FIG. 4 shows some of the current and voltage waveforms associated with the basic embodiment.

FIG. 4 shows some of the current and voltage waveforms associated with the arrangement of FIG. 1.

FIG. 4(*a*) shows the waveform of the voltage V1 provided across light bulb LB under a condition of providing a moderate amount of BOOST; while FIG. 4(b) shows the waveform of the corresponding current I1 flowing through inductor L.

FIG. 4(*c*) shows the waveform of the voltage V2 provided across light bulb LB under a condition of providing maximum amount of BOOST; while FIG. 4(*d*) shows the waveform of the corresponding current I1 flowing through inductor L.

Figure 6:
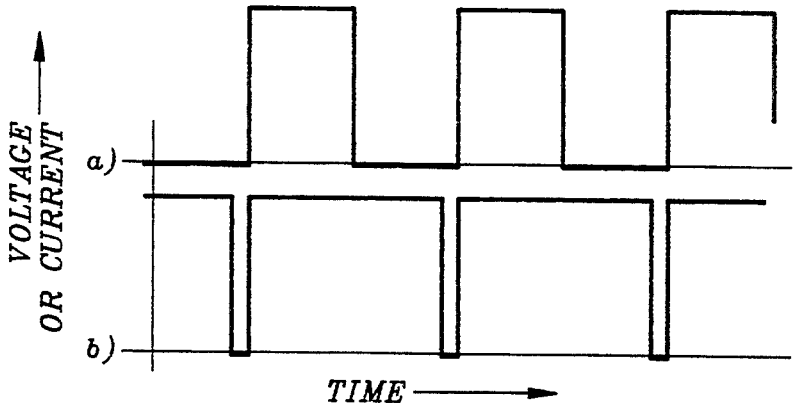
FIG. 6 shows some of the voltage waveforms associated with the alternative basic embodiment of the invention.

FIG. 6 shows some of the current and voltage waveforms associated with the arrangement of FIG. 5.

FIG. 6(*a*) shows the waveform of the voltage V1' provided across light bulb LB' under a condition of providing a moderate amount of BOOST; while FIG. 6(*b*) shows the waveform of the voltage V2' provided across light bulb LB' under the condition of providing the maximum amount of BOOST.

Details of Operation

In the arrangement of FIG. 1, with slideable arm SA in the position shown, battery B is disconnected and no power flows through light bulb LB. With slideable arm SA moved from its first (or OFF) detent D1 and into its second (or ON) detent D2, the full battery voltage gets applied to light bulb LB via slide conductor SC. However, connection is not yet made with slide resistor SR; and forward conversion means FCM constitutes an open circuit between terminals PCT and CT.

Moving slideable arm SA past its ON-detent causes connection to be made between the B+ terminal and slide resistor SR, thereby causing a control current to flow into control input terminals CIT. This control current will cause forward conversion means FCM to start operating such as to cause a short circuit to occur intermittently between junctions J1 and J2.

With reference to FIG. 4, forward conversion means FCM causes a relatively brief short circuit to occur periodically between junctions J1 and J2 (see FIG. 4*a* or 4*c*). During each such brief period of short circuit, the DC voltage of battery B is applied directly across energy-storing inductor L; which means that whatever current was flowing through that inductor just prior to the onset of the short circuit will increase rapidly (see FIG. 4*b* or 4*d*). At the end of each brief period of short circuit, the by-now larger-magnitude inductor current will be switched to flow through light bulb LB. Thereafter, its magnitude will decay in an exponential manner toward the level determined by the ratio of the magnitude of the DC voltage and the magnitude of the resistance of the light bulb.

As a result, the RMS magnitude of the voltage V1 resulting across the light bulb will be larger that it was without the action of the forward conversion means. That is, the reduction in RMS magnitude resulting from the periodic brief short circuits is more than compensated-for by the increase in RMS magnitude resulting from the extra energy imparted to the energy-storing inductor during the periods when the short circuit is present and released during the periods when the short circuit is not present.

Without the action of the forward converter means, the current flowing from the battery would simply be at the level indicated by the minimum points of waveform I1. As a result of the action of the forward converter means, the average magnitude of the current drawn from the battery increases; which increased flow of current simply translates into increased power drawn from the battery; which increased power has no other place to go but into the light bulb.

By varying the duration of the short circuit period, the amount of power applied to the light bulb will vary correspondingly. FIG. 4*c* indicates a situation where the RMS magnitude of the voltage applied across the light bulb has been increased by about 50%.

Forward conversion means FCM may be made in many different ways. For instance, it could be made in the form of a custom integrated circuit expressly designed to perform the function herein specified. Or, it could be made in the manner illustrated by FIG. 2;

which shows a self-oscillating single transistor oscillator.

In the circuit of FIG. 2, when switches OOS and BS are both closed, current flows through adjustable resistor AR, thereby to charge capacitor Cx.

Eventually, the voltage on Cx reaches a magnitude high enough to cause transistor Q to become conductive, at which point current will start flowing into the collector of transistor Q and thereby through primary winding PW1 of saturable current transformer SCT as well. In turn, this flow of collector current will cause additional base current to be provided to the base of transistor Q; and, by means of positive feedback, transistor Q now becomes fully conductive: sufficiently so to constitute an effective short circuit between junctions J1 and J2.

After a brief period of time, such as about 10 microseconds, saturable current transformer SCT saturates, thereby stopping the flow of base current; which therefore causes transistor Q to stop conducting. Now, the increased inductor current will flow into the light bulb; and, as a result, a voltage is induced across auxiliary winding AW; which voltage, by way of diode Dx and secondary winding PW2, is used for resetting saturable current transformer SCT, thereby to make it ready for a new cycle.

While secondary winding SW provided base current for transistor Q, this base current actually flowed out of capacitor Cx and therefore caused the voltage at terminal ST3′ to become quite negative; which, as long as this negative voltage does indeed exist, prevents transistor Q from entering another cycle of positive-feedback-maintained conduction. However, current flowing through adjustable resistor AR will gradually cause the voltage at terminal ST3′ again to become positive and to cause transistor Q to start conducting; whereafter transistor Q, with the help of saturable current transformer SCT, will initiate another positive-feedback-maintained period of conduction.

The lower be the magnitude of the resistance of adjustable resistor AR, the shorter be the time it takes for the negative voltage at terminal ST3′ to be dissipated; and the shorter become the duration of the periods of transistor non-conduction versus the duration of the periods of transistor conduction.

For additional information with respect to the operation of single-ended self-oscillating transistor oscillators, reference is made to U.S. Pat. No. Re. 32,155 to Ole Nilssen.

With respect to the operation of flashlight FL of FIG. 3, it is sufficient to mention that the light output from this flashlight is controlled as follows.

With slide lever SL in the OFF-position, no light is provided. With the slide lever in the ON-position, an ordinary amount of light is provided.

Both the OFF-position and the ON-position are detented.

Pushing slide lever SL past the detented ON-position, light output increases in approximate proportion to the degree to which the slide lever is pushed past the ON-position. When the slide lever is pushed all the way to the indicated MAX-position, the light output will be about four times higher than it is in the normal-output ON-position.

The slide lever is spring-loaded in such manner that, when pushed past the ON-position and without expressly holding it there, it will automatically return to the detented ON-position.

Whereas the arrangement of FIG. 1 is intended for a situation where the light bulb is designed to operate in its normal mode of light output, as well as to have an ordinary life expectancy, when powered with the full voltage available from the battery; the arrangement of FIG. 5 is intended for a situation where the light bulb is designed to have an unusually high level of light output, as well as an unusually short life expectancy, when powered with the full voltage of the battery.

Thus, while the task of forward conversion means FCM of FIG. 1 is that of increasing the RMS magnitude of the voltage applied to the light bulb, thereby to get increased light output in exchange for reduced bulb life expectancy; the task of integrated circuit IC of FIG. 5 is that of decreasing the RMS magnitude of the voltage applied to the light bulb, thereby to get increased bulb life expectancy in exchange for reduced light output.

Thus, in the arrangement of FIG. 5, operating the light bulb so as to attain an ordinary level of light output in combination with an ordinary life expectancy, requires a reduction of the RMS magnitude of the voltage available directly from the battery. By way of integrated circuit IC, this reduction in RMS magnitude is simply attained by connecting/disconnecting the light bulb from the battery in a rapid periodic manner, thereby to reduce the RMS magnitude of the voltage applied to tile light bulb in proportion to the square root of the duty cycle. That is, compared with a 100% or unity duty cycle (where the light bulb is continuously connected with the battery) a 50% of 0.5 duty cycle (where the light bulb is connected with the battery only 50% of the time) gives rise to a reduction of RMS magnitude by a factor equal to the square root of 0.5, or equal to about 0.7.

While the arrangement of FIG. 1 requires an energy-storing inductor in order to attain a voltage magnitude boost; the arrangement of FIG. 5 does not require such an energy-storing means since it does not need to attain a voltage magnitude boost.

The function of the circuit of FIG. 5 is illustrated by the voltage waveforms of FIG. 6.

The voltage waveform of FIG. 6*b* indicates a situation of near maximum BOOST; where the full battery voltage is applied to the light bulb with nearly 100% duty cycle. The voltage waveform of FIG. 6*a* indicates a situation where the full battery voltage is applied to the light bulb with less than 50% duty cycle, such as to cause the RMS magnitude of the voltage applied to the light bulb to be only about two thirds of the full battery voltage, thereby providing for about one fourth the light output and 200 times longer life expectancy as compared with providing the light bulb with the full battery voltage.

The operation of the circuit arrangement of FIG. 7 is substantially the same as that of FIG. 5, except for three important features.

(1) The first of these features relates to the use of two separate batteries in combination to form a hybrid battery pack: first battery B″1 and second battery B″2;

(2) the second of these features relates to an automatic procedure by which to charge second battery B″2 (which is a rechargeable battery) from first battery B″1 (which is a primary battery); and (3) the third of these features relates to means for automatically regulating the RMS magnitude of the voltage provided to light bulb LB″

First battery B"1 is a more-or-less ordinary Alkaline primary battery; second battery B"2 is a more-or-less ordinary Nickel-Cadmium rechargeable battery.

The purpose of second battery B"2 is that of operating as an energy-storing buffer; which is to say: it is used much like an energy-storing capacitor of extremely high capacitance. This energy-storing buffer battery B"2 is charged from primary battery B"1 over a relatively long period of time (and therefore quite efficiently). Once charged, however, buffer battery B"2 will permit—for brief periods at a time—an extra high rate of power output to be provided to light bulb LB", much higher than could possibly have been provided by primary battery B"1 alone. The reason for this is that the internal resistance of an ordinary Nickel-Cadmium battery is very much lower than that of an ordinary Alkaline battery of similar size.

To automatically charge buffer battery B"2 by a predetermined amount of energy (or for a predetermined length of time), it is only necessary to: (i) close switch means SM"; and (ii) momentarily depress momentary switch MS". During this charging procedure, which may last for a few of minutes, adjustable voltage sensor AVS" should be so set as to call for no more than a nominal RMS magnitude of the voltage provide to light bulb LB".

Any time after buffer battery B"2 is charged, adjustable voltage sensor AVS" may be used for the purpose of providing the BOOST function.

The function of adjustable voltage control AVC" is that of permitting manual control of the RMS magnitude of the output voltage (i.e. the voltage provided between terminal T"4 and negative bus NB", which is voltage provided to the terminals of light bulb LB"). When adjustable voltage sensor AVS" is set at its one extreme position, the RMS magnitude of the output voltage is substantially zero; when it is set at its other extreme position, the RMS magnitude of the output voltage is at its maximum level; which maximum level is adjustable by the setting of adjustable resistor AR" and is generally such as to provide for a substantial boost in the light output of light bulb LB" as compared with that light bulb's normal light output.

That is, even if the magnitude of the DC voltage supplied from first battery B"1 may vary from time to time (such as may occur as first battery B"1 gets discharged), or even if different light bulbs were to be used, the RMS magnitude of the output voltage is regulated to be substantially constant at whatever level is called-for by the position of adjustable voltage sensor AVS".

Additional Comments (a) The arrangement of FIG. 1 corresponds to a situation of merely adding the indicated electronic circuitry to an otherwise ordinary flashlight having a common (ex: 3 Volt, two-cell) battery and a matching ordinary (ex: 3 Volt, 50 hour) light bulb.

(b) The arrangement of FIG. 5 corresponds to a situation of either: (i) using an ordinary-voltage (ex: 3 Volt, two-cell) battery in combination with a lower-voltage (ex: 2 Volt, 50 hour) light bulb; or (ii) using a higher-voltage (ex: 4.5 Volt, three-cell) battery in combination with an ordinary-voltage (ex: 3 Volt, 50 hour) light bulb; or (iii) using an ordinary-voltage (ex: 3 Volt, two-cell) battery in combination with a matching short-life/-high-efficacy (ex: 15 minutes life) light bulb; etc.

(c) It is important to realize that in incandescent lamps, such as ordinary light bulbs for flashlights, there is a clear and consistent relationship between luminous efficacy and lamp life. By increasing the RMS magnitude of the voltage applied to a given lamp, the lamp's luminous efficacy increases while its life expectancy decreases. Conversely, by reducing the RMS magnitude of the voltage applied to the lamp, the lamp's luminous efficacy decreases while its life expectancy increases.

(d) Clearly, in the arrangement of FIG. 5, instead of reducing the RMS magnitude provided to the light bulb by way of duty-cycling the connection between the light bulb and the battery, a variable resistor means could be used for attaining such a reduction. However, efficiency (and thereby battery life) would then be severely compromised.

(e) In light of instant disclosure, it is clear that the BOOST feature may be also be attained—although only in a non-variable manner—either: (i) by powering a given light bulb with a two-cell battery and then, to attain a fixed-level BOOST, to switch-in an auxiliary cell such as to increase the RMS magnitude of the voltage applied to the light bulb; or (ii) by connecting to a given battery either one or the other of two light bulbs: one designed for normal operation on the voltage from the given battery, the other designed to provide high-efficacy/short-life operation on that same voltage.

Also, the effect of two light bulbs could be attained by using a light bulb with two filaments.

(f) Just as is the case with forward conversion means FCM of FIG. 1, integrated circuit IC of FIG. 5 may—in the form of a custom integrated circuit made to function in accordance with the functional specifications provided herein—readily and routinely be obtained from a semiconductor manufacturer.

(g) The basic BOOST feature herein disclosed is applicable to various types of battery-powered lighting means, including those wherein the light output is provided by gas discharge lamps.

(h) Clearly, the BOOST feature is basically intended to be used for only a small percentage of the total usage time of a flashlight. Normally, a flashlight with the BOOST feature would have a light bulb that would have a life expectancy of about 50 hours if used continuously in the ON-position and about 15 minutes if used continously in the MAX-BOOST position.

In actual usage, it is expected that the flashlight will be used in the plain ON-position most of the time, and in the MAX-BOOST-position for only a small fraction of the time. What is important to understand is that each minute of usage on the MAX-BOOST-position is equivalent—as far as wear of the light bulb is concerned—to over three hours of usage in the plain ON-position. However, due partly to the much increased luminous efficacy associated with the MAX-BOOST-position, battery life will be much less affected by use of the MAX-BOOST-position: continuous operation in the MAX-BOOST-position would only shorten battery life by a factor of two or so; yet, the total net resulting light output (in Lumen-hours) attained from the battery would have doubled.

(i) The word "lamp" is herein defined to include various forms and types of incandescent light bulbs (ex: light bulbs for battery-powered hand-held flashlights) as well as gas discharge lamps (ex: fluorescent lamps for camper lanterns).

(j) In light of the invention herein disclosed, is it clear that the circuit arrangement illustrated by FIGS. 5 and 6 can be used for light DIMMING as well as for light BOOSTING. That is, it would readily be feasible to power the light bulb (in an adjustable manner) at less than the normal amount of power, thereby attaining longer than normal lamp life expectancy.

Also, while provisions are made for spring-loaded automatic return to regular ON-position after having used the BOOST-position, a similar automatic return from a DIM-position would not be necessary. Hence, in some lighting products it would be anticipated that the light control function include a detented OFF-position, a continuous DIMMING-range, a detented ON-position, an automatic-return BOOSTING-range, and an automatic-return MAX-BOOST-position.

(k) Also, by slight modification of the circuit arrangement of FIG. 5, mechanical switch means (such as TPS) may be entirely eliminated. Instead, integrated circuit IC may be made in such manner as to provide for all the required switching functions, for instance by way of a simple high-resistance potentiometer; which would provide both for the ON/OFF function as well as for the continuous-range DIMMING/BOOSTING function.

(l) By using a simple photo-sensor to sense the luminous output from the light bulb, and to feed the output from this photo-sensor back to integrated circuit IC, it is simple to provide for automatic control of luminous output, thereby to compensate for reduced battery output voltage with wear as well as for diminished luminous efficacy as the light bulb ages.

Of course, any changes in battery voltage can be automatically compensated-for merely by so specifying the IC.

(m) It is anticipated that it be desirable in some cases to filter the current provided to the light bulb, thereby to avoid possible mechanical resonances in the filament due to the high frequency content of the chopped voltage. In the arrangement of FIG. 5, this filtering would not need to consist of more than a filter capacitor connected in parallel with the light bulb and a filter inductor connected in series with the parallel-combination of the light bulb and the filter capacitor.

(n) In the arrangement of FIG. 7, the nominal voltage of first battery B″l is somewhat higher than that of second battery B″2, thereby making the charging of the second battery by the first battery particularly simple. However, by using a forward conversion arrangement, as in FIGS. 1 and 2, the nominal voltages of the two batteries do not have to match one another.

(o) In situation where initial battery cost would be of lesser importance, a Lithium battery might be particularly appropos as first battery B″I. For a given size, a Lithium battery would have more energy available than an ordinary Alkaline battery. However, the internal resistance of a Lithimum battery is substantially higher than that of an Alkaline battery; which would therefore make the use of a Nickel-Cadmium battery particularly appropos as a buffer for such a Lithium battery.

(p) As energy is drained from it, the terminal voltage of an ordinary Alkaline primary battery gradually diminishes. Typically, a nominal 6 Volt Alkaline battery loaded at 0.5 Ampere provides an output voltage of 5.5 Volt when it is new, but provides only about 3.5 Volt after half the available energy is consumed. Thus, the amount of light provided by a flashlight powered by such a battery diminishes drastically as the battery is used. In all probability, before the battery is even halfway discharged, the light output would be so diminished (by a factor of more than three to one) as to cause the ordinary user to assume that the battery must be replaced. Hence, the feature of regulating the RMS magnitude of the voltage provided to the light bulb in a flashlight provides for a major de facto increase in useful battery life.

(q) Whereas an Alkaline (or a Lithium) battery may be stored for years without losing a significant portion of its energy, a charged Nickel-Cadmium battery loses its energy after but a few months. Thus, in at least some applications, it is important not to arrange for the Alkaline battery to charge the Nickel-Cadmium battery on a continuous basis. Instead, as is indeed provided-for in the arrangement of FIG. 7, the Nickel-Cadmium battery receives only a pre-determined modest amount of charge at a time, and then only after having been expressly called-for (as by momentarily depressing momentary switch MS″) by the user of the flashlight.

(r) Clearly, the combination hybrid battery pack herein described may be useful in applications other than flashlights. For instance, instead of light bulb LB″ in FIG. 7, a portable radio may be the load; and arrangements can be made whereby the Nickel-Cadmium battery is being programmably charged whenever the radio is in use. That way, a far higher peak audio power level may be provided than would be possible to provide from the Alkaline batteries alone.

(s) In the arrangement of FIGS. 1 and 2, it should be noted that the RMS magnitude of the voltage provided across the terminals of light bulb LB is higher than that of the DC voltage provided by battery B.

(t) It is believed that the present invention and its several attendant advantages and features will be understood from the preceeding description. However, without departing from the spirit of the invention, changes may be made in its form and in the construction and/or interrelationships of its component parts, the form herein presented merely representing the currently preferred embodiment.

I claim:

1. An arrangement comprising:

a first battery having battery terminals across which there exists a first unidirectional voltage of a first magnitude; the first battery having a first internal resistance;

a second battery having battery terminals across which there exists a second unidirectional voltage of a second magnitude; the second battery being a rechargeable battery and having a second internal resistance; the first internal resistance being substantially higher than the second internal resistance;

a light bulb; and control and connect means connected in circuit with the first battery, the second battery and the light bulb; the control and connect means being operative: (i) during certain periods to cause the second battery to be charged from the first battery; and (ii) at certain times to cause electric power to be provided from at least one of the batteries to the light bulb, at least some of the electric power provided to the light bulb being at least some of the time provided from the second battery.

2. The arrangement of claim 1 combined with adjustment means operative to permit manual adjustment of the amount of electric power provided to the light bulb.

3. The arrangement of claim 1 wherein: (i) an output voltage is provided to the light bulb; and (ii) the control means comprises regulation means operative to maintain the RMS magnitude of the output voltage substantially constant in spite of significant variations in the first magnitude.

4. An arrangement comprising:

a primary battery limited by its internal resistance to provide at a pair of primary battery terminals no more than a certain maximum output power;

a lamp load; and power conditioner connected in circuit between the primary battery and the lamp load; the power conditioner having energy-storing means and being operative during a certain time period to provide an amount of power to the lamp load that is substantially higher than said maximum output power; the duration of said certain time period being on the order of several seconds; at least part of said amount of power cumulating over said certain time period to a certain amount of energy, which amount of energy having previously been supplied to the energy-storing means from the primary battery; the power conditioner being additionally characterized by including rechargeable battery.

5. The arrangement of claim 4, wherein the reachargeable battery has an internal resistance that is substantially lower than that of the primary battery.

6. An arrangement comprising:

a primary battery limited by its internal resistance to provide at a pair of primary battery terminals no more than a certain maximum output power;

a lamp load; and a power conditioner connected in circuit between the primary battery and the lamp load; the power conditioner including a rechargeable battery and being operative during certain periods to provide an amount of power to the lamp load that is substantially higher than said maximum output power; the rechargeable battery being at times recharged from the primary battery.

* * * * *